US009194616B2

(12) United States Patent
Xu et al.

(10) Patent No.: US 9,194,616 B2
(45) Date of Patent: Nov. 24, 2015

(54) CRYOGENIC REFRIGERATOR

(75) Inventors: Mingyao Xu, Tokyo (JP); Takaaki Morie, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 395 days.

(21) Appl. No.: 13/604,890

(22) Filed: Sep. 6, 2012

(65) Prior Publication Data

US 2013/0067936 A1 Mar. 21, 2013

(30) Foreign Application Priority Data

Sep. 21, 2011 (JP) ..... 2011-206442

(51) Int. Cl.

*F25B 9/00* (2006.01)
*F25B 9/14* (2006.01)
*F25B 9/10* (2006.01)

(52) U.S. Cl.

CPC ... *F25B 9/14* (2013.01); *F25B 9/00* (2013.01); *F25B 9/10* (2013.01); *F25B 9/145* (2013.01); *F25B 2309/1423* (2013.01); *F25B 2500/01* (2013.01)

(58) Field of Classification Search

CPC ..... F25B 9/10; F25B 9/14; F25B 9/145; F25B 9/00
USPC ..... 62/6, 55.5
See application file for complete search history.

(56) References Cited

U.S. PATENT DOCUMENTS 5,481,879 A * 1/1996 Asami ..... F25B 9/14 60/520
2009/0107150 A1* 4/2009 Yuan et al. ..... 62/6

FOREIGN PATENT DOCUMENTS

JP H07-324831 12/1995
JP 2003-314918 * 4/2002 ..... 62/6
JP 3851929 11/2006

* cited by examiner

*Primary Examiner* — Frantz Jules
*Assistant Examiner* — Keith Raymond
(74) *Attorney, Agent, or Firm* — IPUSA, PLLC

(57) ABSTRACT

A disclosed cryogenic refrigerator includes a first stage displacer; a first stage cylinder configured to form a first expansion between the first stage cylinder and the first stage displacer; a second stage displacer connected to the first stage displacer; and a second stage cylinder configured to form a second expansion space between the second stage cylinder and the second stage displacer, wherein a helical groove is formed on an outer peripheral surface of the second stage displacer so as to helically extend from a side of the second expansion space toward the first stage displacer, the helical groove communicates with the first expansion space, and a cross-sectional area of the helical groove becomes smaller from a side of the second expansion space to a side of the first expansion space.

5 Claims, 6 Drawing Sheets

CRYOGENIC REFRIGERATOR

CROSS-REFERENCE TO RELATED APPLICATIONS

This patent application is based upon and claims the benefit of priority of Japanese Patent Application No. 2011-206442 filed on Sep. 21, 2011, the entire contents of which are incorporated herein by reference.

BACKGROUND OF THE INVENTION

1. Field of the Invention

The present invention generally relates to a cryogenic refrigerator which generates cold (a cold thermal energy causing an ultracold temperature) by generating Simon expansion using a high pressure refrigerant gas supplied from a compression device.

2. Description of the Related Art

Patent Document 1 discloses that a clearance sealing mechanism is provided on an outer peripheral surface of a second stage displacer on a high temperature side and a helical groove is provided on the outer peripheral surface on the side other than the high temperature side. With this structure, a surface heat pumping function of a refrigerant gas inside the helical groove is used for refrigeration of a refrigerator.

[Patent Document 1] Japanese Patent No. 3851929

SUMMARY OF THE INVENTION

According to an aspect of the present invention, there is provided a cryogenic refrigerator including a first stage displacer; a first stage cylinder configured to form a first expansion between the first stage cylinder and the first stage displacer; a second stage displacer connected to the first stage displacer; and a second stage cylinder configured to form a second expansion space between the second stage cylinder and the second stage displacer, wherein a helical groove is formed on an outer peripheral surface of the second stage displacer so as to helically extend from a side of the second expansion space toward the first stage displacer, the helical groove communicates with the first expansion space, and a cross-sectional area of the helical groove becomes smaller from a side of the second expansion space to a side of the first expansion space.

DETAILED DESCRIPTION OF THE PREFERRED EMBODIMENTS

According to a technique described in Patent Document 1, a refrigerant efficiency performed by the refrigerant gas inside the helical groove is insufficient.

The object of the embodiments of the present invention is to provide a cryogenic refrigerator which can enhances refrigeration efficiency of the refrigerant gas inside the helical groove.

Preferred embodiments of the present invention are explained next with reference to accompanying drawings.

First Embodiment

Figure 1:
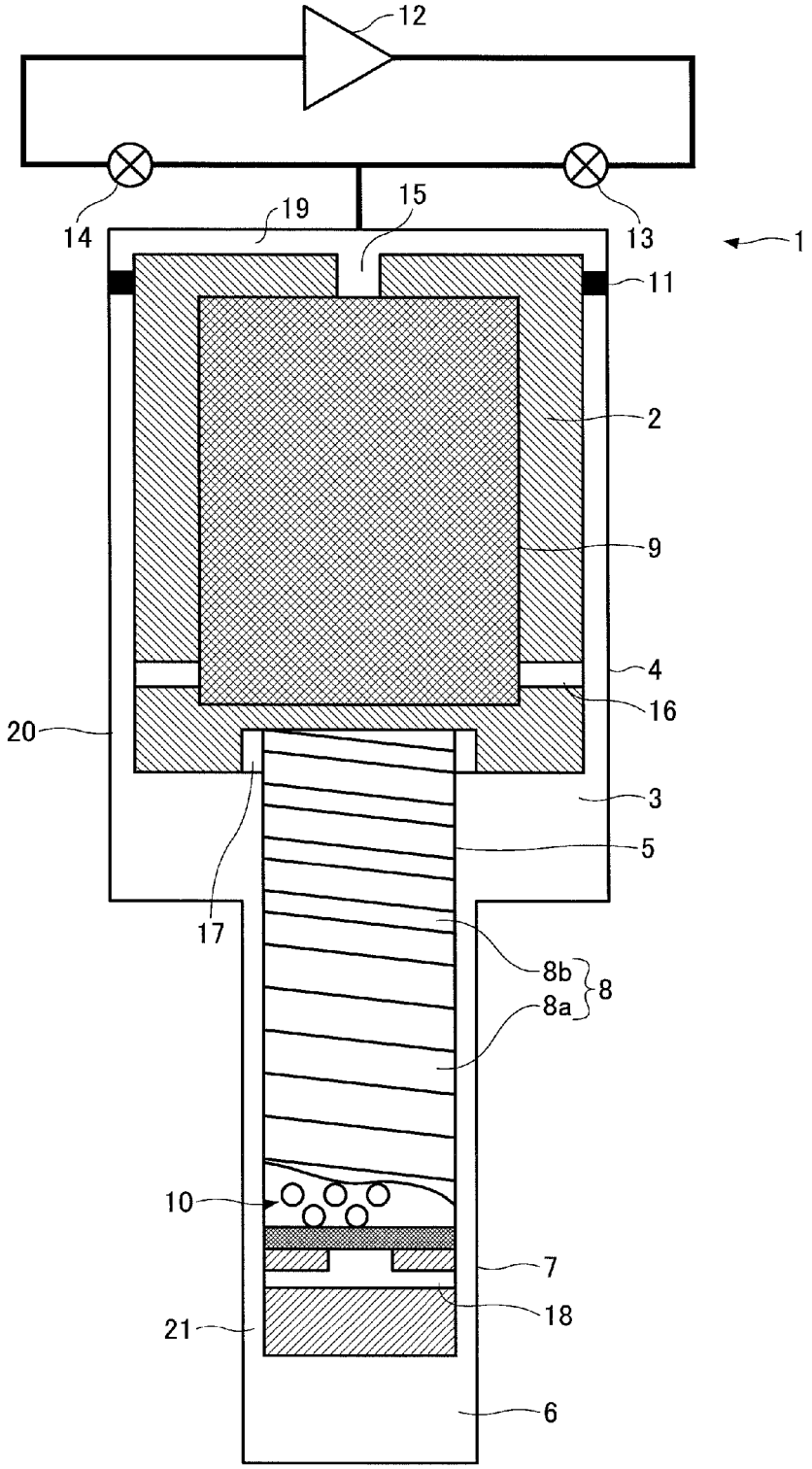
FIG. 1 schematically illustrates an exemplary cryogenic refrigerator 1 of first embodiment.

A cryogenic refrigerator 1 of a first embodiment is a Gifford-McMahon (GM) type refrigerator using, for example, a helium gas as a refrigerant gas. Referring to FIG. 1, the cryogenic refrigerator 1 includes a first stage displacer 2 and a second stage displacer 5 connected to the first stage displacer 2 in series in a longitudinal direction of the first stage displacer 2.

The first stage cylinder 4 and the second stage cylinder 7 are integrally formed. A low temperature end of the first stage cylinder 4 is connected to a high temperature end of the second stage cylinder 7 at around a bottom portion of the first stage cylinder 4. The first and second stage cylinder 4 and 7 are shaped like cylinders and coaxially arranged. The diameter of the second stage cylinder 7 is smaller than the diameter of the first stage cylinder 4. The first stage cylinder 4 accommodates the first stage displacer 2 so that the first stage displacer 2 can reciprocate inside the first stage cylinder in a longitudinal direction of the first stage cylinder 4. The second stage cylinder 7 accommodates the second stage displacer 5 so that the second stage displacer 5 can reciprocate inside the second stage cylinder 7 in a longitudinal direction of the second stage cylinder 7.

For example, stainless steel may be used as a material of the first and second stage cylinders 4 and 7 to achieve high strength, low heat conductivity, and sufficient helium interruption capability. The second stage displacer 5 is made by forming a coating of a wear-resistant resin such as a fluorine resin on an outer peripheral surface of a metallic cylinder made of stainless steel.

The high temperature end of the first stage cylinder 4 has a scotch yoke mechanism (not illustrated) reciprocating the first stage displacer 2 and the second stage displacer 5. The first stage displacer 2 and the second stage displacer 5 reciprocate inside the first stage cylinder 4 and the second stage cylinder 7, respectively.

The first stage displacer 2 has a cylindrical outer peripheral surface and is filled with a first regenerative material. The internal volume of the first stage displacer 2 is substantially the same as the volume of the first regenerator 9. The high temperature end of the first stage displacer 2 has a first opening 15 for circulating a refrigerant gas from a room temperature chamber 19 to a first stage displacer 2. The room temperature chamber 19 has a space formed by a first stage cylinder 4 and a high temperature end of the first stage displacer 2. The volume of the space of the room temperature chamber 19 changes by the reciprocation of the first stage displacer 2. The room temperature chamber 19 is connected to a supply and eject pipe among pipes connecting a supply and eject system including a compressor 12, a supply valve 13, and a return valve 14. A sealing portion 11 is provided between the high temperature end of the first stage displacer 2 and the first stage cylinder 4.

A second opening 16 for introducing the refrigerant gas via the first heat exchanger 20 to the first expansion space 3 is formed to the low temperature end of the first stage displacer 3. The first expansion space 3 is formed by a first stage cylinder 4 and the first stage displacer 2. The volume of the first expansion space 3 changes by the reciprocation of the first stage displacer 2. A first cooling stage (not illustrated) is provided on the outer periphery of the first stage cylinder 4 at a position corresponding to the first expansion space 3. The first cooling stage is cooled by the first heat exchanger 20.

The second stage displacer 5 has a cylindrical outer peripheral surface and is filled with a second regenerative material. The internal volume of the second stage displacer 5 is substantially the same as the volume of the second regenerator 10. The first expansion space 3 and the high temperature end of the second stage displacer 5 are connected by a communicating passage 17. The refrigerant gas flows from the first expansion space 3 to the second regenerator 10 via the communicating passage 17.

A fourth opening 18 for introducing the refrigerant gas via the second heat exchanger 21 to the second expansion space 6 is formed at the low temperature end of the second stage displacer 5. The second expansion space 6 is formed by a second stage cylinder 7 and the second stage displacer 5. The volume of the second expansion space 6 changes by the reciprocation of the second stage displacer 5. The second heat exchanger 21 has a clearance formed between the low temperature end of the second stage cylinder 7 and the second stage displacer 5. The clearance is formed to be greater than a clearance between the helical groove of the second stage displacer 5 having and the second stage cylinder 7.

A second cooling stage (not illustrated) is provided on the outer periphery of the second stage cylinder 7 at a position corresponding to the second expansion space 6. The second cooling stage is cooled by the second heat exchanger 21.

For example, a phenol resin including fabric or the like is used for the first stage displacer 2 to obtain a lighter specific gravity, more sufficient wear resistance, higher strength, and lower heat conductivity. For example, a woven metallic wire or the like is used for the first regenerative material. For example, the second regenerative material may be formed by holding lead spheres by felt and a woven metallic wire in an axial direction of the second regenerator 8.

The helical groove 8 is formed on the outer peripheral surface of the second stage displacer 5. The helical groove 8 has a start end communicating with the second expansion space 6 via the second heat exchanger 21 and helically extends on the side of the first expansion space 3. The helical groove 8 includes a helical groove 8*a* and a helical groove 8*b*. The cross-sectional area of the helical groove 8*a* is on a lower (high temperature) side in FIG. 1, and a cross-sectional area 8*b* of the helical groove 8*a* is on a higher (low temperature) side in FIG. 1. The cross-sectional area of the low temperature side helical groove 8*a* is greater than a cross-sectional area of the high temperature side helical groove 8*b*. The high temperature side helical groove 8*b* has an end positioned at the upper end of the second stage displacer 5. The end of the high temperature side helical groove 8*b* communicates with the first expansion space 3. The cross-sectional area of the helical groove 8 gradually decreases from the side of the second expansion space 6 to the side of the first expansion space 3 in a stepwise fashion. Specifically, referring to FIG. 2, the number of steps is two and the depth of the high temperature side helical groove 8*b* is small to thereby make the cross-sectional area of helical groove 8*b* smaller than the cross-sectional area of the high temperature side helical groove 8*a*. The length of the high temperature side helical groove 8*b* in the axial direction of the second stage displacer 5 is longer than the stroke of reciprocating the second stage displacer 5. Thus, even when the second stage displacer 5 is positioned at an upper dead end, the high temperature side helical groove 8*b* exists inside the second stage cylinder 7.

Figure 3:
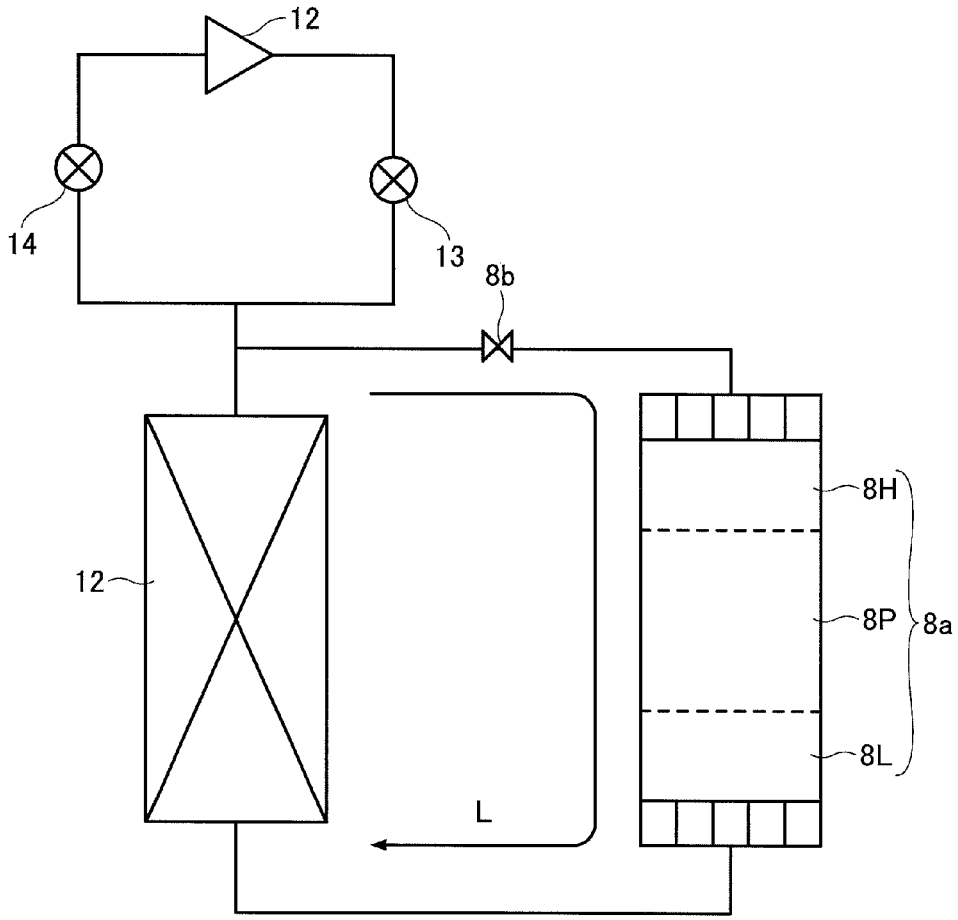
FIG. 3 schematically illustrates a flow of a gas in which a side clearance of the cryogenic refrigerator is regarded as a pulse tube of a virtual pulse refrigerator.

FIG. 3 illustrates a flow of the refrigerant gas in which the helical groove is regarded as a virtual pulse tube of a virtual pulse tube type refrigerator (pulse refrigerator). The high temperature side helical groove 8*b* corresponds to a virtual double inlet (an orifice) provided in a communicating passage connecting the second regenerator 10 and the high temperature side of the low temperature side helical groove 8*a* (the pulse tube). The refrigerant gas inside the low temperature side helical groove 8*a* corresponds to a virtual gas piston 8P (a substantially center portion of the low temperature side helical groove 8*a*) in FIG. 3. Thus, the helical groove 8 and the second regenerator 10 can be regarded as a virtual double inlet type pulse tube refrigerator.

The length of the virtual gas piston 8P in the axial direction and the phase of the virtual gas piston 8P may be adjusted so that the virtual gas piston 8P is always accommodated inside the helical groove 8*a* during reciprocation of the low temperature side helical groove 8*a* and so that a high temperature side space 8H exists on the high temperature side of the virtual gas piston 8P and a low temperature side space 8L exists on the low temperature side of the virtual gas piston 8P. The length of the virtual gas piston 8P in the axial direction and the phase of the virtual gas piston 8P are adjusted by the virtual double inlet functioning as a phase adjusting mechanism. The double inlet corresponds to the cross-sectional area of the high temperature side helical groove 8*b* illustrated in FIG. 2.

Next, the operation of the refrigerator is described. At a certain time point of supplying the refrigerant gas, the first stage displacer 2 and the second stage displacer 5 are positioned at lower dead ends in the first stage cylinder 4 and the second stage cylinder 7, respectively. At this timing or a timing slightly different from this timing, the supply valve 13 is opened. Then, a high pressure helium gas is supplied inside the first stage cylinder 4 from a supply and eject pipe via the supply valve 13. The high pressure helium gas flows inside the first stage displacer 2 (into the first regenerator 9) from the first opening 15 positioned at the upper portion of the first stage displacer 2. The high pressure helium gas flowing inside the first regenerator 9 is supplied into the first expansion space 3 via the second opening 16 positioned at the lower portion of the first stage displacer 2 while being cooled by the first regenerative material.

Most of the high pressure helium gas supplied to the first expansion space 3 is then supplied to the second regenerator 10 via the communication passage 17. The rest of the high pressure helium gas, which is not supplied to the first expansion space 3, is supplied through the high temperature side helical groove 8*b* to the high temperature side of the low temperature side helical groove 8*a*. This gas corresponds to the helium gas existing in the high temperature side space 8H in FIG. 3, which functions to prevent the virtual gas piston 8P from flowing toward the first expansion space 3 from the helical groove 8*a*.

The high pressure helium gas flowing into the second regenerator is cooled further by the second regenerative material and then supplied to the second expansion space 6 via the fourth opening and the second heat exchanger 21. A part of the high pressure helium gas supplied to the second expansion space 6 is supplied inside the low temperature side helical groove 8*a* from the low temperature side. This gas corresponds to the helium gas existing inside the low temperature side space 8L in FIG. 3.

As described above, since the cross-sectional area of the high temperature side helical groove 8*b* is smaller than the cross-sectional area of the low temperature side helical groove 8*a*, the inflow resistance for the helium gas flowing into the high temperature side space 8H (flowing inside the helical groove 8*a*) is relatively greater than the inflow resistance for the helium gas flowing into the low temperature side space 8L (flowing inside the helical groove 8*a*). Therefore, the amount of the helium gas flowing inside the high temperature side space H is smaller than the amount of the helium gas flowing inside the low temperature side space L thereby preventing the gas in the high temperature side space 8H from flowing into the second expansion space 6.

As described, the first expansion space 3, the second expansion space 6 and the helical groove 8*a* are filled with the high pressure helium gas and the supply valve 13 is closed. At this time, the first stage displacer 2 and the second stage displacer 5 are positioned at the upper dead ends in the first stage cylinder 4 and the second stage cylinder 7, respectively. At this timing or a timing slightly different from this timing, the return valve 14 is opened. Then, the refrigerant gas inside the first expansion space 3, the second expansion space 6 and the helical groove 8*a* are depressurized to thereby expand. The temperature of the helium gas becomes low by the expansion. The helium gas in the first expansion space 3 absorbs heat of the first cooling stage via the first heat exchanger 20. The helium gas in the second expansion space 6 absorbs heat of the second cooling stage via the second heat exchanger 21.

The first stage displacer 2 and the second stage displacer 5 move toward the lower dead ends thereby reducing the volumes of the first expansion space 3 and the second expansion space 6. The helium gas inside the second expansion space 6 is recovered into the first expansion space 3 via the opening 18 and the second regenerator 10. At this time, the helium gas in the low temperature side space 8L of the helical groove 8*a* is also recovered via the second expansion space 6, and the helium gas in the high temperature side space 8H of the low temperature side helical groove 8*a* flows inside the first expansion space 3 via the high temperature side helical groove 8*a*.

The helium gas in the first expansion space 3 returns to the compressor 12 via the second opening 16 and the first regenerator 9 to a suction side of the compressor 12. At this time, the first regenerative material and the second regenerative material are cooled by the refrigerant gas. These processes form one cycle. The first cooling stage and the second cooling stage are cooled by repeating the cycle.

The following functions and effects are obtainable by the cryogenic refrigerator 1 of the first embodiment. By forming a virtual gas piston 8P inside the low temperature side helical groove 8*a*, the virtual gas piston 8P functions as a sealing portion for preventing the helium gas from communicating between the low temperature side and the high temperature side of the side clearance.

Additionally, the side clearance can be regarded as a pulse tube type refrigerator. Then, it is possible to use the low temperature side space 8L on the low temperature side of the virtual gas piston 8P can be used as a third expansion space. Thus, it is possible to enhance a capability of cooling with the two cooling stages.

In the above cryogenic refrigerator 1 of the first embodiment, the length of the high temperature side helical groove 8*b* having the small cross-sectional area on the second stage displacer 5 in the axial direction of the second stage displacer 5 may be longer than the stroke of reciprocating the second stage displacer 5. Even if the second stage displacer 5 is positioned at the upper dead end, the function of the double inlet described above can be secured.

Within the first embodiment, it is possible to stabilize a phase adjusting function. Therefore, it is possible to stabilize the length and the phase of the virtual gas piston 8P and the above described function of the sealing portion. Further, the refrigeration efficiency can be further securely enhanced by providing the third expansion space.

Said differently, the enhancement of the refrigeration efficiency by the virtual gas piston 8P can be explained as follows. In the helical groove 8 formed on the outer peripheral surface of the second stage displacer 5, if the low temperature side helical groove 8*a* is greater than the high temperature side helical groove 8*b*, the helium gas intruding (leaking) from the high temperature side through the side clearance can be trapped by the helical groove 8*a* so as to be shielded. Therefore, if the cross-sectional area of the low pressure side helical groove 8*a* becomes greater, it is possible to trap more working fluid such as the refrigerant gas.

When a working fluid leaking from the high temperature side is mixed with a working fluid inside the low temperature side of the helical groove 8*a*, the temperature of the working fluid is lowered. In a case where the working fluid of which temperature is lowered flows at a low temperature end, enthalpy is smaller than in a case where the helical groove 8 penetrates from the high temperature side to the low temperature side. Thus, a leakage loss can be reduced. In a manner similar thereto, by penetrating the helical groove 8 from the low temperature side to the high temperature side, even if the working fluid such as the refrigerant gas inside the helical groove is compressed, heat dissipated on the high pressure end can be reduced.

Second Embodiment

In the above cryogenic refrigerator 1 of the first embodiment, the high pressure helium gas flows from the first expansion space 3 to the low temperature side helical groove 8*a* through the high pressure side helical groove 8*a*. The low pressure helium gas flows from the low temperature side helical groove 8*a* to the first expansion space 3. Said differently, the refrigerant gas bi-directionally flows through the high temperature side helical groove 8*b* which functions as double inlets. Since a high pressure helium gas has a density higher than that of a low pressure helium gas, the high pressure helium gas has a smaller flow rate and a smaller pressure loss than the low pressure helium gas. Therefore, the amount of the high pressure helium gas flowing through the high pressure helical groove 8*b* per cycle is slightly greater than the amount of the low pressure helium gas flowing through the high pressure helical groove 8*b* per cycle. Therefore, the flow rate of the high pressure helium gas per cycle is slightly, greater than the flow rate of the low pressure helium gas per cycle. Thus, the gas flow rates in the bi-directional flows are not balanced. As a result, a steady-state flow directing from the high temperature side of the low temperature side helical groove 8*a* to the low-temperature side of the low temperature side of the helical groove 8*a* may be generated every time the cooling cycles are repeated. Referring to FIG. 3, this flow is a secondary flow along an arrow L in a clockwise direction.

Figure 4A:
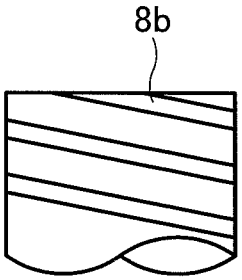
FIGS. 4A and 4B schematically illustrate exemplary cryogenic refrigerators of a second embodiment.
Figure 4B:
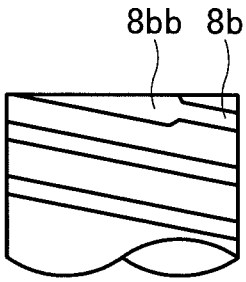

Within the second embodiment, instead of the constant cross-sectional area of the high temperature side helical groove 8*b* in the first embodiment as illustrated in FIG. 4A, the cross-sectional area of the high temperature side helical groove 8*b* is continuously increased toward the first expansion space 3 as illustrated in FIG. 4B. Said differently, a tapered portion 8*bb* is formed at a portion opening to the first expansion space 3 of the high temperature side helical groove 8*b*. Referring to FIG. 4B the cross-sectional area of the high temperature side helical groove 8*b* is adjusted by changing the width perpendicular to the winding direction of the high temperature side helical groove 8*b* at the tapered portion 8*bb*.

However, the depth perpendicular to the width and the winding direction may be adjusted alone or in addition to the adjustment of the width.

Figure 2:
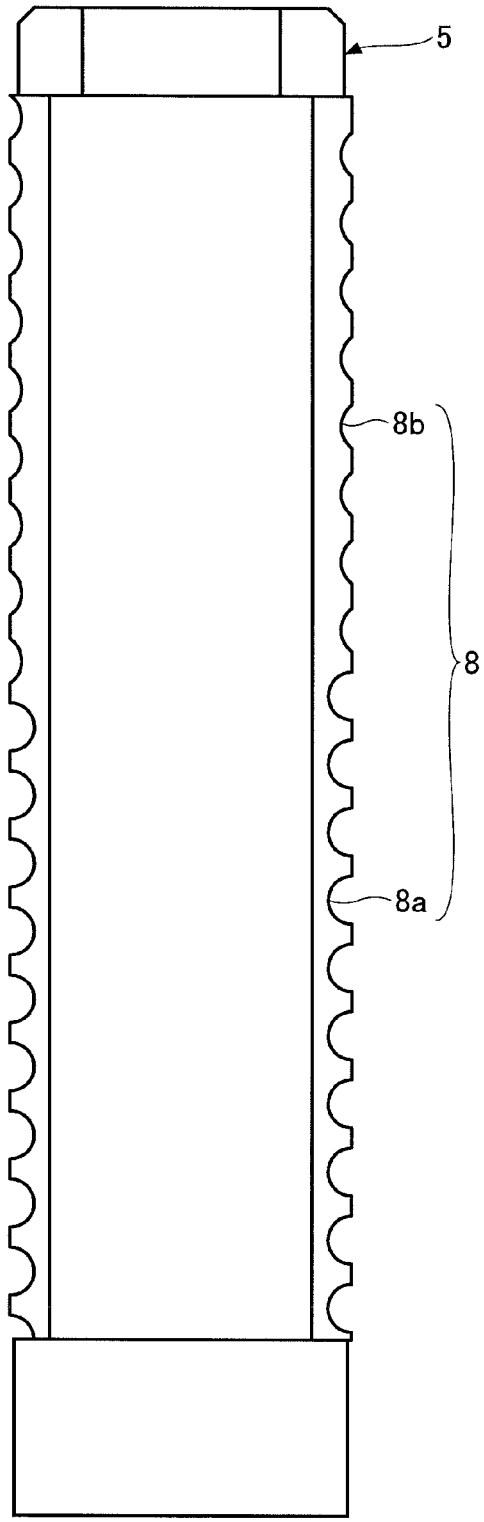
FIG. 2 schematically illustrates a helical groove of a second stage displacer of the cryogenic refrigerator of the first embodiment.

With this, the tapered portion 8*bb* can cause a resistance for preventing the secondary flow illustrated in FIG. 2 from being generated. Said differently, the flow path resistance in the high temperature side helical groove 8*b* from the first expansion space 3 to the low temperature side helical groove 8*a* is greater than the flow path resistance in the high temperature side helical groove 8*b* from the low temperature side helical groove 8*a* to the first expansion space 3 thereby restricting generation of the secondary flow L. Therefore, a heat loss caused by the secondary flow L can be prevented to thereby enhance refrigeration efficiency.

Third Embodiment

The third embodiment is described next. Within the first and second embodiments, there are two different cross-sectional areas of the helical groove 8. However, the number of the cross-sectional areas may be three.

Figure 5:
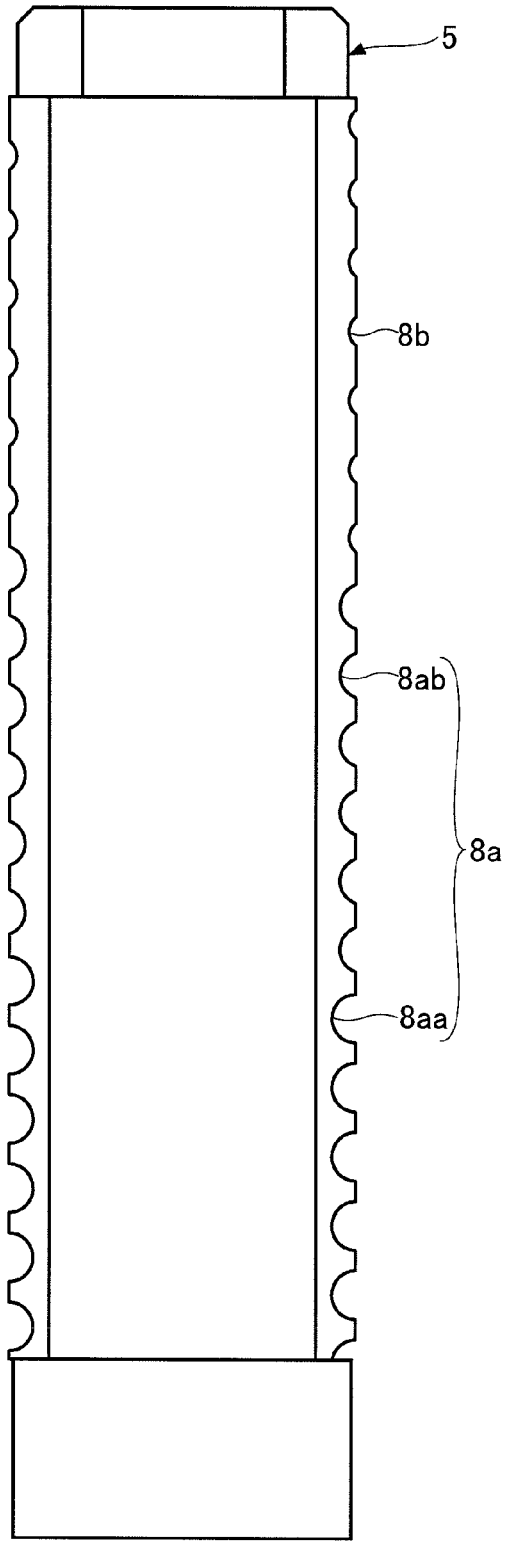
FIG. 5 schematically illustrates an exemplary cryogenic refrigerator of a third embodiment.

Except for the helical groove 8, the cryogenic refrigerator 1 of the third embodiment has a structure basically similar to that of the first embodiment. Therefore, the same reference symbols are applied to the same portions and description of the different portions are mainly described. Referring to FIG. 5, a cryogenic refrigerator of the third embodiment includes a helical groove formed on an outer peripheral surface of a second stage displacer 5 and helically extending from a second expansion space 6. The helical groove 8 communicates with a first expansion space 3. The cross-sectional area of the helical groove 8 is smaller on a side of the first expansion space 3 than on a side of the second expansion space and gradually decreases in a three-stage stepwise fashion from the second expansion space 6 to the first expansion space 3.

Within the third embodiment, the helical groove 8 includes three portions of a helical groove 8*aa* of a helical groove 8*a*, helical groove 8*ab* of the helical groove 8*a*, and a helical groove 8*b* in an order of reducing the cross-sectional areas. The helical groove 8*b* having the smallest cross-sectional area functions as a virtual double inlet and is always partly positioned lower than the first expansion space 3, namely the bottom portion of a first stage cylinder 4.

Referring to FIG. 5, the cross-sectional areas of the helical grooves 8*aa*, 8*ab* and 8*b* are defined on a cross-sectional view of the second stage displacer 5 passing through the central axis of the second stage displacer 5. These cross-sectional areas of the helical grooves 8*aa*, 8*ab* and 8*b* are adjusted by both of the depth and width of the helical grooves, and the shapes of the grooves are rounded. The cross-sectional areas may be obtained in a cross-sectional view in perpendicular to the winding direction of the helical groove 8. Further, the shapes of the grooves may be rectangular.

Within the third embodiment, in a manner similar to the first embodiment in FIG. 5, the high pressure side helical groove 8*a* including the helical grooves 8*aa* and 8*ab* forming a side clearance between the outer peripheral surface of the second stage displacer 5 and the inner peripheral surface of the second stage cylinder 7 is regarded as a pulse tube type refrigerator to thereby constitute a virtual gas piston 8P. Then, it becomes possible to appropriately adjust the length and the phase of the virtual gas piston 8P using the helical groove 8*b* as the virtual double inlet.

Then, it becomes possible to enhance refrigeration efficiency by securely providing a sealing portion function by the virtual gas piston 8P to thereby prevent a leakage loss. Further, the refrigeration efficiency can also be enhanced by additionally cooling a cooling stage using a low temperature side space 8L of the helical groove 8*a* as a third expansion space.

Fourth Embodiment

Within the above first to third embodiments, the cross-sectional area of the helical groove 8 is changed in the stepwise fashion in the axial direction (a longitudinal direction) of the second displacer 5. However, the cross-sectional area of the helical groove 8 may be continuously reduced toward the first expansion space 3. The fourth embodiment is described next. Except for the continuous reduction of the cross-sectional area of the helical groove 8, the cryogenic refrigerator 1 of the fourth embodiment has a structure basically similar to that of the first embodiment. Therefore, the same reference symbols are applied to the same portions and description of the different portions are mainly described.

Figure 6:
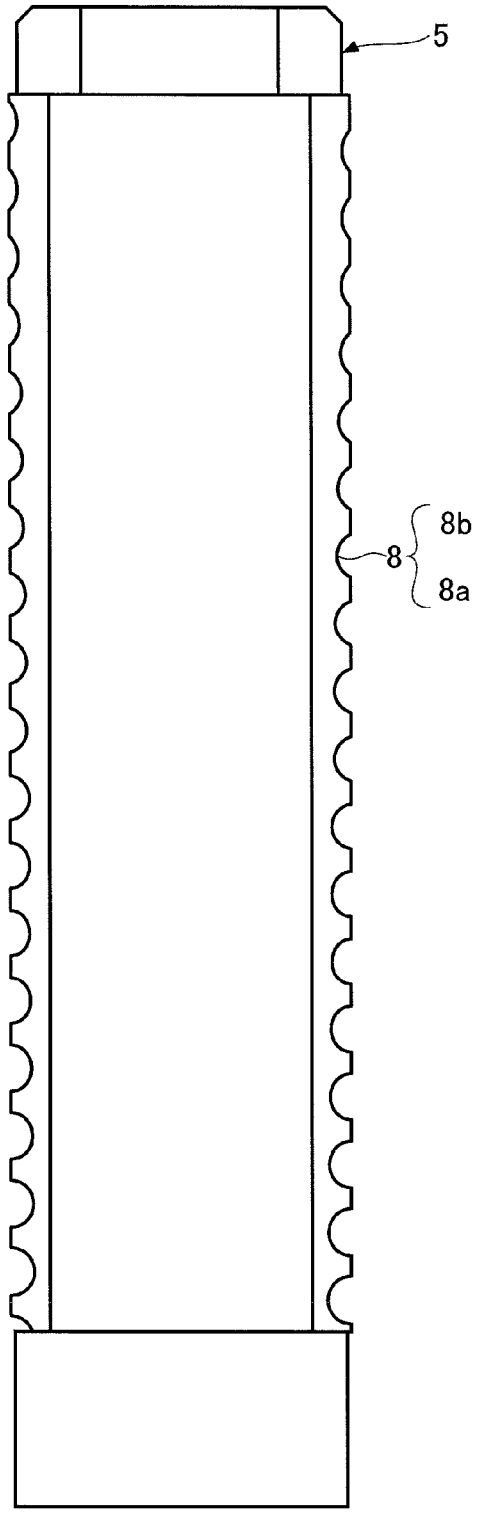
FIG. 6 schematically illustrates an exemplary cryogenic refrigerator of a fourth embodiment.

Referring to FIG. 6, in a cryogenic refrigerator 1 of the fourth embodiment, a helical groove 8 is formed on the outer peripheral surface of a second stage displacer 5 so as to helically extend from a second expansion space 6. The cross-sectional area of the helical groove 8 continuously decreases from a first end communicating with the second expansion space 6 to a first expansion space 3.

Within the fourth embodiment, in a manner similar to the first embodiment, a low temperature side helical groove 8*a* forming a side clearance between the outer peripheral surface of the second stage displacer 5 and the inner peripheral surface of the second stage cylinder 7 is regarded as a pulse tube type refrigerator to thereby constitute a virtual gas piston 8P. Here, the helical groove 8 forming a side clearance between the outer peripheral surface of the second stage displacer 5 and the inner peripheral surface of the second stage cylinder 7 is divided at an arbitrary position (i.e., a border) in an axial direction of the second stage displacer 5 such as about two-thirds of the total length of the second stage displacer 5. The low temperature side helical groove 8*a* is positioned on a low temperature side of the border, and the high temperature side helical groove 8*b* is positioned on a high temperature side of the border. Then, it becomes possible to appropriately adjust the length and the phase of the virtual gas piston 8P using the helical groove 8*b* as the virtual double inlet.

Said differently, a leakage loss is prevented to enhance refrigeration efficiency. Further, a low temperature side space 8L inside the helical groove 8*a* is used as a third expansion space to thereby enhance the refrigeration efficiency.

Although the cryogenic refrigerator described above has the two stages of the displacers, the number of the stages may be changed to three or the like.

The cross-sectional areas of the low and high temperature side helical grooves 8*a* and 8*b* may be determined on a plane (a cross-sectional view) passing through the central axis of the second stage displacer 5 or a plane (a cross-sectional view) perpendicular to the winding direction of the helical groove 8. The cross-sectional areas may be changed by adjusting the depth, the width or both of the depth and the width. The shapes of the cross-sectional areas may be any one of a curved shape, a rectangular shape and so on.

With the above embodiments, an example where a cryogenic refrigerator is a GM refrigerator is described. However, the embodiments are not limited thereto. For example, the embodiments are applicable to any refrigerator having a displacer such as a Stirling type refrigerator or a Solvay type refrigerator.

Within the embodiments, although the helical groove 8 is formed at an end portion of the second stage displacer 5 on a high temperature side, the embodiments are not limited thereto. As far as the low temperature side helical 8*a* reaches the first expansion space 3 when the second stage displacer 5 is positioned at the lower dead end, an effect similar to the above is obtainable.

As described, according to the embodiments, it becomes easy to adjust the length in the axial direction and the phase of the virtual gas piston in using the side clearance as the virtual pulse tube type refrigerator.

Further, according to the embodiments, it becomes possible to enhance the refrigeration efficiency of the refrigerator as a whole by enhancing the refrigeration efficiency of a refrigerant gas inside the helical groove.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the cryogenic refrigerator has been described in detail, it should be understood that the various changes, substitutions, and alterations could be made hereto without departing from the spirit and scope of the invention.

What is claimed is:

1. A cryogenic refrigerator comprising:

a first stage displacer;

a first stage cylinder configured to form a first expansion space between the first stage cylinder and the first stage displacer;

a second stage displacer connected to the first stage displacer; and a second stage cylinder configured to form a second expansion space between the second stage cylinder and the second stage displacer, wherein a helical groove is formed on an outer peripheral surface of the second stage displacer so as to helically extend from a side of the second expansion space toward the first stage displacer, and includes a high temperature side helical groove and a low temperature side helical groove, which sequentially extend in a longitudinal direction of the second stage displacer so that the high temperature side helical groove is positioned on a side of the first expansion space and the low temperature side helical groove is positioned on a side of the second expansion space, wherein a cross-sectional area of the high temperature side helical groove positioned on the side of the first expansion space is smaller than a cross-sectional area of the low temperature side helical groove positioned on the side of the second expansion space, wherein an upper end of the high temperature side helical groove is in fluid communication with the first expansion space, wherein a length of the high temperature side helical groove is determined so that, when the second stage displacer is positioned at an upper dead end of a stroke of the second stage displacer reciprocating inside the second stage cylinder, at least a part of the high temperature side helical groove exists inside the second stage cylinder, and when the second stage displacer is at a lower dead end of the stroke, at least another part of the high temperature side helical groove exists in the first expansion space.

2. The cryogenic refrigerator according to claim 1, wherein the helical groove becomes stepwise smaller from the side of the second expansion space to the side of the first expansion space in a three-stage stepwise fashion and includes a first helical groove which has a maximum cross-sectional area, a second helical groove which has a medium cross-sectional area, and a third helical groove which has the minimum cross-sectional area.

3. The cryogenic refrigerator according to claim 1, wherein the helical groove becomes continuously smaller from the side of the second expansion space to the side of the first expansion space.

4. The cryogenic refrigerator according to claim 1, wherein the cross-sectional area is adjusted by a depth of the helical groove.

5. The cryogenic refrigerator according to claim 1, wherein the helical groove includes a tapered portion opening on a side of the first expansion space.

* * * * *